United States Patent [19]

Burgess

[11] Patent Number: 4,967,995

[45] Date of Patent: Nov. 6, 1990

[54] COMBINATION COVER AND DISPENSER FOR AN ICE CUBE TRAY

[76] Inventor: John Burgess, 111 North Seneca Rd., Oak Ridge, Tenn. 37830

[21] Appl. No.: 392,083

[22] Filed: Aug. 9, 1989

Related U.S. Application Data

[63] Continuation-in-part of Ser. No. 316,296, Feb. 27, 1989, abandoned.

[51] Int. Cl.[5] ..... B28B 7/06; B28B 7/08; B28B 7/24

[52] U.S. Cl. ..... 249/70; 220/350; 220/351; 249/121; 249/126; 249/127; 249/203

[58] Field of Search ..... 249/69, 70, 120, 121, 249/126, 127, 128, 203, 204; 220/345, 350, 351

[56] References Cited

U.S. PATENT DOCUMENTS

| | | | |
|---|---|---|---|
| 2,117,516 | 5/1938 | Skidelsky | 320/345 |
| 2,164,832 | 7/1939 | Nitardy | 220/345 |
| 2,503,693 | 4/1950 | Lennep | 249/121 |
| 3,374,982 | 3/1968 | Sallade | 249/121 |
| 3,414,229 | 12/1968 | Norberg | 249/121 |
| 3,527,373 | 9/1970 | Giraudet et al. | 220/345 |
| 3,648,831 | 3/1972 | Arnone | 220/345 |
| 3,804,330 | 4/1974 | Miller, Jr. et al. | 220/345 |
| 3,829,056 | 4/1974 | Baker et al. | 249/121 |
| 4,113,098 | 9/1978 | Howard | 220/351 |
| 4,432,529 | 2/1984 | McMillan | 249/121 |
| 4,789,130 | 12/1988 | Stich et al. | 249/126 |
| 4,815,691 | 3/1989 | Cooley | 249/121 |
| 4,883,251 | 11/1989 | Manas | 249/121 |

FOREIGN PATENT DOCUMENTS

| | | | |
|---|---|---|---|
| 794550 | 9/1935 | France | 220/345 |

*Primary Examiner*—Jay H. Woo
*Assistant Examiner*—Khanh P. Nguyen
*Attorney, Agent, or Firm*—Luedeka, Hodges & Neely

[57] ABSTRACT

A cover for an ice cube tray includes a top portion for covering the top of an ice cube tray and sidewalls joined to the top portion which permits the top portion to be raised to a position at which the top position is spaced above the tray top. The cover also includes flanges joined to the sidewalls for limiting the distance that the top portion can be raised above the tray top. Once the cover raised to its spaced, or elevated, position and the tray and cover are inverted and canted to an inclined condition, the top portion and sidewalls provide a chute for accepting ice cubes dropped from the tray and for directing the dropped ice cubes off the lower end of the cover.

7 Claims, 2 Drawing Sheets

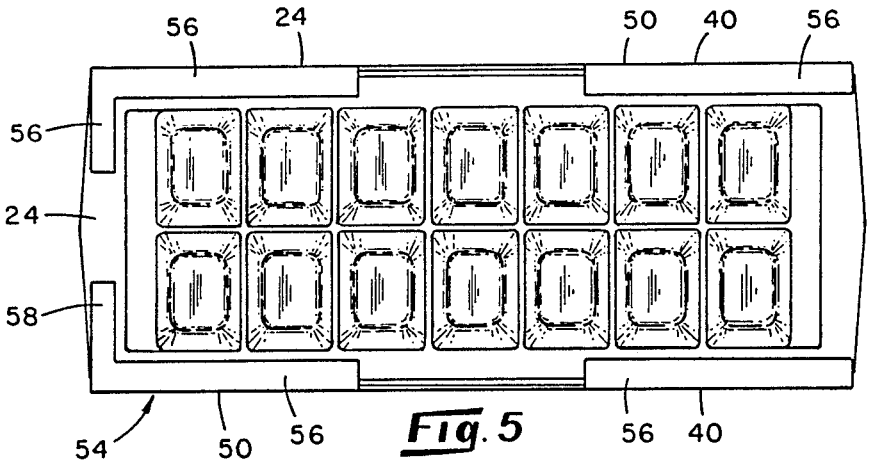
Fig. 5
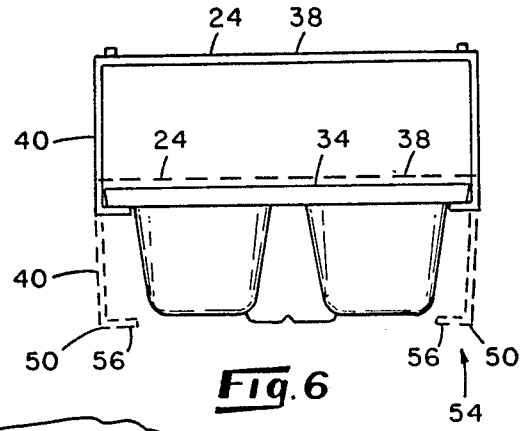
Fig. 6
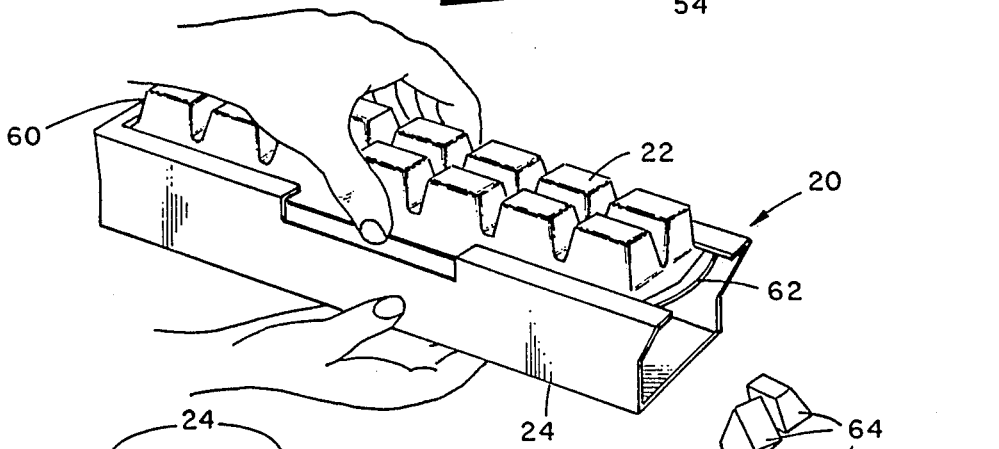
Fig. 7
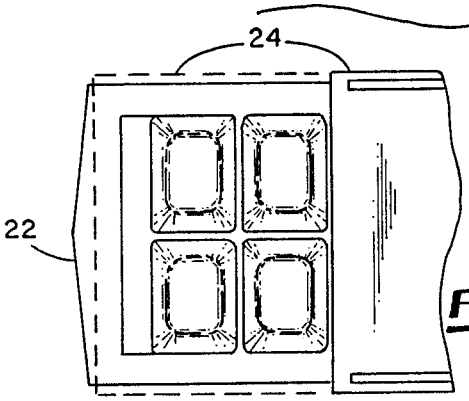
Fig. 8
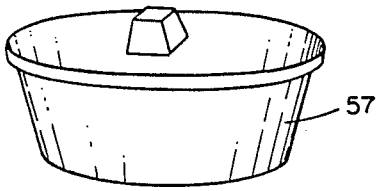

COMBINATION COVER AND DISPENSER FOR AN ICE CUBE TRAY

BACKGROUND OF THE INVENTION

This is a continuation-in-part of application Ser. No. 316,296, filed Feb. 27, 1989 and entitled Ice Tray Cover/Dispenser now abandoned.

This invention relates generally to ice cube trays and relates more specifically to means and methods for covering ice cube trays and for dispensing ice cubes from such trays.

It is an object of the present invention to provide a new and improved cover for an ice cube tray which facilitates the dispensing of ice cubes from the tray.

Another object of the present invention is to provide such a cover that reduces any likelihood of water spillage as a tray, filled with water, is transported between sites.

Still another of the present invention is to provide such a cover upon which a tray can be stacked.

Yet another of the present invention is to provide such a cover that facilitates removal of a predetermined number of ice cubes from a tray.

A further object of the present invention is to provide such a cover which prevents the lossage of ice fragments which may otherwise break and fall uncontrolled from the ice cube tray while the tray is emptied.

A still further object of the present invention is to provide such a cover which prevents unwanted debris from falling into the tray before ice cubes are formed therein.

A yet further object of the present invention is to provide such a cover which is uncomplicated in construction yet effective in operation.

One more object of the present invention is to provide an ice cube tray assembly which incorporates such a cover.

SUMMARY OF THE INVENTION

This invention resides in a cover for an elongated ice cube tray including a plurality of upwardly-opening compartments within which ice cubes are formed and wherein the openings of the compartments collectively provide a substantially rectangular top for the ice cube tray. The tray further includes means providing an outwardly-extending lip which extends around the rectangular top of the tray and having a height which correspond generally to the depth of the ice cube compartments.

The cover includes a substantially planar top portion positionable across so as to cover the rectangular top of the tray and means providing a pair of sidewalls arranged on opposite sides of the top portion. The top portion includes a pair of opposite side edges for extending generally along the length of the ice cube tray and two opposite end edges extending between the side edges. The sidewalls are joined to the side edges of the top portion so as to extend downwardly from and generally a right angle to the top portion to accommodate a moving of the top portion relative to and away from the rectangular tray top from a lowered position at which the top portion operatively covers the tray top to a raised position at which the top portion is spaced from the tray top by a predetermined distance which is at least as great as the depth of the ice cube compartments. The sidewalls and top portion cooperate with one another so that when the top portion is moved from its lowered position to its raised position and the tray and cover are inverted and canted to an inclined condition, the sidewalls and top portion provide a chute for directing ice cubes which fall out of the compartment openings off one end of the top portion.

The cover also includes stop means associated with the sidewalls for cooperating with the lip of the tray to limit the movement of the top portion relative to and away from the top of the tray to the predetermined distance.

BRIEF DESCRIPTION OF THE DRAWINGS

FIG. 5 is a plan view of the FIG. 1 assembly as seen generally from below in FIG. 1.

FIG. 6 is a view similar to that of FIG. 4 illustrating the condition of the assembly cover when moved to a raised position relative to the tray.

FIG. 7 is perspective view of the FIG. 1 tray assembly when dispensing ice cubes formed therein.

FIG. 8 is a top plan view of the FIG. 1 tray assembly illustrating a condition of the cover for emptying a preselected number of ice cubes from the tray.

DETAILED DESCRIPTION OF THE ILLUSTRATED EMBODIMENT

Figure 1:
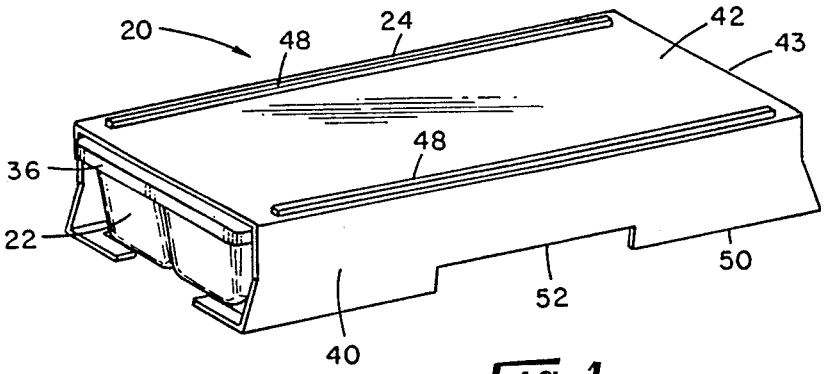
FIG. 1 is a perspective view of an ice cube tray assembly within which an embodiment of a cover is incorporated.
Figure 2:
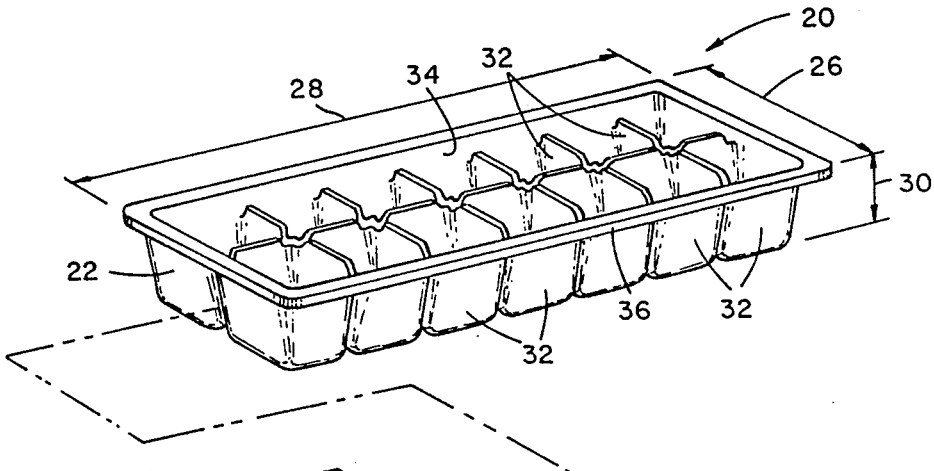
FIG. 2 is perspective view of the FIG. 1 tray assembly, shown exploded.
Figure 2:
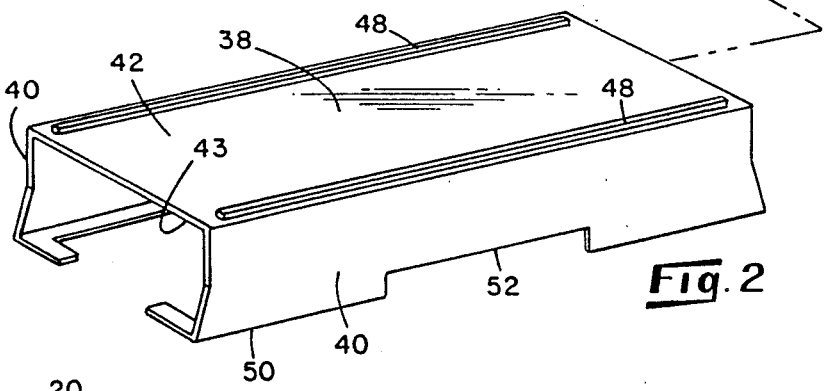

Turning to the drawings in greater detail, there is illustrated in FIGS. 1 and 2 an embodiment of an ice cube tray assembly, generally indicated 20, within which water is frozen to form ice cubes and from which the formed ice cubes are dispensed. The assembly 20 includes an ice cube tray 22 and a cover 24 for covering the cubes before and after the cubes are formed and for facilitating the dispensing of the formed cubes from the tray 22.

Figure 3:
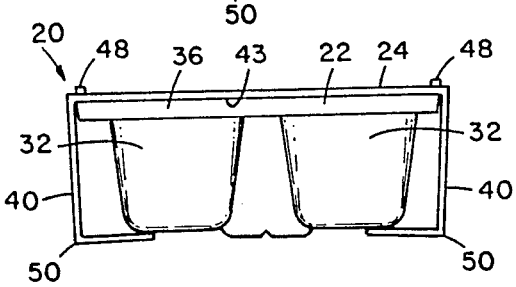
FIG. 3 is an end elevational view of the FIG. 1 tray assembly as seen generally from the left in FIG. 1.
Figure 4:
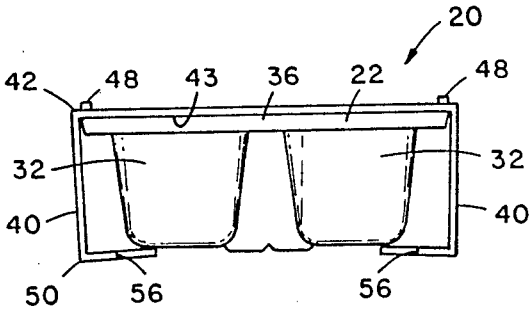
FIG. 4 is an end elevational view of the FIG. 1 tray assembly as seen generally from the right end in FIG. 1.

The ice cube tray 22, conventional in construction, is elongated in shape and resembles a rectangular prism having a width 26, a length 28 and height 30. The tray 22 includes a plurality of individual ice cube compartments 32 of equal depth and arranged in two rows along the length of the tray 22. The tray 22 also includes means defining an upwardly-directed rectangular top opening 34 across which the individual compartments 32 are disposed and an outwardly-extending lip 36 extending around the rectangular top opening 34. As best viewed in FIGS. 3 and 4, the sidewalls of each compartment 32 are tapered inwardly as a path is traced from the top to the bottom of the compartment 32 to facilitate the removal of formed ice cubes. Although the tray 22 may be constructed of a number of materials, the illustrated tray 22 is formed as a one-piece body out of a flexible plastic material which permits the tray 22 to be manually flexed to loosen cubes formed therein.

With reference again to FIGS. 1 and 2, the cover 24 includes means providing a top portion 38 and sidewalls 40 joined to so as to extend downwardly from the top portion 38. The top portion 38 is in a form of a relatively thin platen having solid rectangular top and bottom surfaces 42, 43 respectively, of such size and shape so as to completely cover the rectangular opening 34 of the ice cube tray 22 when operatively positioned thereover. To this end, top surface 42 of the cover 24 includes a width and a length which correspond, respectively, to the width 26 and length 28 of the rectangular top opening 34 of the tray 22.

The bottom surface 43 of the cover top portion 38 is planar so as to flatly overlie the rectangular opening 34 of the tray 22 when the cove 24 is positioned thereover. The top surface 42 includes a major portion which is planar and includes two upwardly-projecting ridges 48 adjacent the side edges of the top portion 38. The ridges 48 are parallel to one another and spaced apart by a distance which is slightly greater than the width of the tray 22 as measured across its bottom. When stacking a tray which is similar in construction and size to that of the tray 22 upon the cover 24, the tray of like construction is positionable between the two ridges 48 in a manner preventing any lateral shifting of the stacked tray relative to the cover 24.

With reference to FIGS. 1–4, each sidewall 40 is in the form of a relatively thin platen which is joined at a substantially right angle to the side edges of the top portion 38. Each sidewall 40 is solid and has a length which corresponds generally to the length of the top portion 38 and a height which is at least as great as the depth of each ice cube compartment 32. Each sidewall 40 includes a lower edge 50 having a notch 52 for a reason apparent herein.

The tray 22 and cover 24 cooperate with one another to permit the cover 24 to be moved or shifted from a lowered position, as illustrated in phantom in FIG. 6, at which the top portion 38 engageably overlies the rectangular top opening 34 of the tray 22 to a raised position, as illustrated in solid lines in FIG. 6, at which the top portion 38 is spaced from the top of the tray 22 by a distance which is at least as great as the depth of each ice cube compartment 32. As the cover 24 is moved between its FIG. 6 raised and lowered positions, the cover sidewalls 40 slidably move along the outer edges of the lip 36.

The cover 24 also includes stop means, generally indicated 54, for limiting the upward movement of the cover 24 relative to the tray 34. In the depicted cover embodiment 24, the stop means 54 includes a set of side flanges 56 joined to so as to be directed inwardly of the lower edges 50 of the sidewalls 40. That is to say, each side flange 56 is joined to a corresponding sidewall edge 50 so as to be directed generally toward the opposite sidewall 40. As best shown in FIG. 5, the set of side flanges 56 includes a pair of opposing flanges 56 adjacent each end of the cover, and each side flange 56 possesses a width which corresponds generally to the width of the lip 36. When the cover 24 has been moved from the FIG. 6 lowered position toward the FIG. 6 raised position by a distance which corresponds generally to the height of the sidewalls 40, the side flanges 56 abuttingly engage the underside of the lip 36 to prevent further upward movement.

Although the cover 24 may be constructed of any of a number of materials, it is preferably constructed as a one-piece unit out of a flexible plastic material. Such a flexible construction permits the cover 24 to flex as the tray 22 is flexed in order to loosen cubes formed therein.

To use the cover 24 in a manner facilitating the dispensing of frozen cubes, the cover 24 is moved to its FIG. 6 raised condition and inverted to a canted condition as illustrated in FIG. 7 at which one tray end, indicated 60, is higher than the other tray end, indicated 62. At that point, ice cubes 64 formed in the tray are dislodged from the compartments 32, by manually bending or flexing the tray 22, so that the dislodged cubes 64 fall onto the surface 43 of the top portion 48. Because the top portion 38 is spaced from the tray opening a distance which is at least as great as the depth of the ice cube compartments 32, the ice cubes which fall from the compartments 3 completely clear the tray opening 34 before striking the top portion 38. The top portion 38 and sidewalls 40 cooperate to funnel the dislodged cubes to the lower tray end 62, as viewed in FIG. 7, and out through the open end of the cover 24. By positioning the lower tray end 62 above a suitable receptacle 57, the dislodged cubes 64 are directed by the cover 24 into the receptacle 57. Thus, the cover 24 serves as a chute into which cubes 64 are emptied from the tray 22 and for directing the dislodged cubes 64 along a preselected path. A related advantage provided by the cover 24 is that when inverted, the cover 24 contains any ice chips or fragments which may otherwise fall uncontrolled from the inverted tray 22 and directs such chips or fragments toward and off the lower end of the cover top portion 38. Therefore, the cover 24 reduces any likelihood that ice will be lost as the tray 22 is emptied and is further advantageous in this respect.

To prevent the cover 24 from sliding downwardly along the length of the tray 22 from its position illustrated in FIG. 7, the cover 24 also includes opposing tabs 58, as best illustrated in FIG. 5, joined to the flange 56 adjacent the end of the cover 24 corresponding to the tray end 60. When the tray assembly 20 is positioned in its FIG. 7 condition, the tabs 58 abut the ice cube compartments 32 adjacent the tray end 60 to prevent slippage of the cover 24 downwardly relative to the tray 22.

The cover 24 also facilitates the dispensing of a predetermined number of cubes from the tray 22 while the other cubes remain within the tray 22. In this connection, the cover 24 can be shifted endwise relative to the tray 22 in a telescoping fashion to expose a predetermined number of cubes. If, for example, only four ice cubes are desired to be dispensed from the tray 22, the cover 24 is shifted endwise from the position illustrated in phantom in FIG. 8 at which all of the ice cubes compartments 32 are covered to a position illustrated in solid lines in FIG. 8 at which four of the ice cube compartments 32 are exposed. Once the desired number of compartments are exposed, the top portion 38 is held against the tray top 34, and the tray 22 is inverted to dump the cubes from the exposed compartments 32. As the cover 24 is shifted endwise as aforedescribed, the sidewalls 40 slidably move along the outer edges of the lip 36.

The cover 24 is further advantageous in that its top portion 38, when held over the compartments 32, reduces any likelihood that water will spill from the compartments 32 when the tray 22, once filled with water, is transported between two sites, such as between a kitchen sink and a freezer. In addition, the notches 52 defined along the sidewall edges 50 accommodate easy grasping of the tray 22 for positioning of the tray assembly 20 in its FIG. 7 condition, as viewed in FIG. 7.

It will be understood that numerous modifications and substitutions ca be had to the aforedescribed embodiment without departing from the spirit of the invention. For example, although the aforedescribed cover 24 has been shown and described as a separate unit for utilization with a tray 22 of conventional construction, the invention may be embodied in a tray assembly including a non-conventional tray and a cooperating cover which facilitates the dispensing of cubes from the tray in a manner like that of cover 24. Accordingly, the aforedescribed cover 24 is intended for the purpose of illustration and not as limitation.

What is claimed is:

1. An ice tray assembly comprising:

an elongated ice tray including a plurality of upwardly-opening compartments within which ice cubes are formed and wherein the openings of the compartments collectively provide a substantially rectangular top for the ice tray, the tray further including an outwardly-extending lip which extends around the rectangular top and having a height which corresponds generally to the depth of the ice cube compartments; and a cover including:

(a) a substantially planar top portion positionable across so as to cover the rectangular top of the tray and including a pair of side edges for extending generally along the length of the ice tray and two opposing end edges extending between the side edges;

(b) a pair of sidewalls arranged on opposite sides of the ice tray and joined to the side edges of the top portion and extending downwardly from and at generally a right angle to the top portion to accommodate a moving of the top portion relative to and away from the tray top from a lowered position at which the top portion operatively covers the tray top to a raised position at which the top portion is spaced from the tray top by a predetermined distance which is at least as great as the depth of the ice cube compartments, said sidewalls and top portion cooperating with one another so that when the top portion is moved from its lowered position to its raised position and the assembly is inverted and canted to an inclined condition, the sidewalls and top portion provide a chute for directing ice cubes which fall out of the compartment openings off one end of the top portion; and (c) limiting means attached to the sidewalls for limiting the movement of the top portion relative to and away from the tray top by said predetermined distance.

2. The assembly as defined in claim 1 wherein each sidewall includes a lower edge extending along the length of the tray and said limiting means includes inwardly-directed flanges joined to the sidewalls along the lower edge thereof for engaging the lip extending around the tray top when the cover top portion is moved upwardly from its lowered position to its raised position by said predetermined amount to thereby prevent further upward movement of the top portion.

3. The assembly as defined in claim 2 further including inwardly-directed tabs joined to the inwardly-directed flanges at one end of said cover so that when the top portion is moved from its lowered position to its raised position and the assembly is inverted and canted to an inclined condition so that said one cover end is higher than the other cover end, the tabs cooperate with the ice tray to prevent the cover from slipping downwardly relative to the ice tray.

4. The assembly as defined in claim 1 wherein said top portion has an upper surface and said upper surface defines a pair of upwardly-directed ridges extending along the length of said cover so that an ice tray of construction like that of the assembly tray can be positioned upon said upper surface and between said ridges to facilitate the stacking of a tray upon said assembly.

5. The assembly as defined in claim 1 wherein each of the tray and cover are constructed of a flexible material which permits the cover and tray to be flexed to loosen formed ice cubes from the ice cube compartments.

6. The assembly as defined in claim 1 wherein each sidewall is solid as a path is traced across each face thereof to prevent passage of ice therethrough when dispensing ice cubes along the provided chute.

7. The assembly as defined in claim 1 wherein each sidewall has a notched lower edge accommodating a grasping of the ice tray through the sidewalls.

* * * * *